US005733148A

United States Patent [19]

Kaplan et al.

[11] Patent Number: 5,733,148

[45] Date of Patent: Mar. 31, 1998

[54] ELECTRICAL CONNECTOR WITH PROGRAMMABLE KEYING SYSTEM

[75] Inventors: Jeffrey Dana Kaplan, New Cumberland; Paul Steven Sremcich, Harrisburg; Judith Lynn Herrington, Carlisle, all of Pa.

[73] Assignee: The Whitaker Corporation, Wilmington, Del.

[21] Appl. No.: 627,558

[22] Filed: Apr. 4, 1996

[51] Int. Cl.[6] ..... H01R 13/64

[52] U.S. Cl. ..... 439/680; 439/79

[58] Field of Search ..... 439/78, 79, 680, 439/681, 885, 937

[56] References Cited

U.S. PATENT DOCUMENTS

| | | | |
|---|---|---|---|
| 4,348,073 | 9/1982 | Worth et al. . | |
| 4,391,482 | 7/1983 | Czeschka . | |
| 4,448,467 | 5/1984 | Weidler . | |
| 4,580,868 | 4/1986 | Verstijnen . | |
| 4,655,517 | 4/1987 | Bryce . | |
| 4,666,325 | 5/1987 | Vantouroux | 403/13 |
| 4,747,792 | 5/1988 | Strate | 439/681 |
| 4,772,227 | 9/1988 | Pelzl et al. | 439/681 |
| 4,773,881 | 9/1988 | Adams, III | 439/681 |
| 4,813,892 | 3/1989 | Strate | 439/681 |
| 5,019,947 | 5/1991 | Pelzl | 361/451 |
| 5,022,862 | 6/1991 | Martin et al. | 439/940 X |
| 5,066,236 | 11/1991 | Broeksteeg | 439/79 |
| 5,417,590 | 5/1995 | Dechelette et al. | 439/607 |
| 5,613,882 | 3/1997 | Hnatuck et al. | 439/680 X |

FOREIGN PATENT DOCUMENTS

| | | | |
|---|---|---|---|
| 0036770A2 | 9/1981 | European Pat. Off. | H01R 13/645 |
| 0179999A | 5/1986 | European Pat. Off. | H01R 13/64 |
| 7149083 U | 6/1973 | Germany | H01R 13/64 |

OTHER PUBLICATIONS

PCT Search Report; 16582PCT; PCT/US97/05648; International Filing Date Apr. 4, 1997; Applicant The Whitaker Corporation; pages 3 pages.

*Primary Examiner*—Khiem Nguyen
*Attorney, Agent, or Firm*—Katherine A. Nelson

[57] ABSTRACT

An electrical connector (12) including an insulative body (14) defining at least one row of terminal sites (36) containing respective terminals (40), the body (14) defining a connection face (16) and an opposed face (18) extending between opposed first and second sides (20, 28). At least one of the first and second sides (20, 28) defines a web (22, 30) between adjacent ones of all the terminals sites (36), whereby each web (22, 30) is adapted to be easily removed to define a corresponding keyway (26, 34). The connector (12) is thereby programmable to correspond with a complementary keyed electrical article (50).

8 Claims, 2 Drawing Sheets

ELECTRICAL CONNECTOR WITH PROGRAMMABLE KEYING SYSTEM

FIELD OF THE INVENTION

This invention relates to electrical connectors and more particularly to a programmable keying system for keying two connector housings to each other.

BACKGROUND OF THE INVENTION

Providing keys and keyways on two housings of an electrical connector assembly is common practice in the connector industry to assure that the two housings can be assembled or mated to each other and one of the housings cannot be coupled or mated to an otherwise identical housing for which it is not intended. Many connector assemblies use loose piece parts for keys and keyway plugs to provide the desired keying arrangement for the connectors. Assembling multiple keyway plugs and keys, however, can be time consuming and there is also a possibility that errors can be made during the assembly process. Additionally a number of different parts may be needed in order to provide the desired different keying arrangements.

One method of providing keying for at least one of the mating connectors is to mold a first housing having a plurality of outwardly extending projections molded at specific locations or molded at selected intervals such that they may be selectively broken away to provide a particular keying arrangement. With such a system a mating housing such as, for example, a post header would be molded with the complementary arrangement of keyway recesses. These keying systems again require a number of different mating connectors to effect a plurality of keying arrangements. For example, a receptacle housing of a selected size and using this system may be provided with a plurality of keys that can be selectively removed to provide a number of different keying arrangements matable with a plurality of complementary housings. The mating connector, on the other hand, would be molded to provide the keyways at specific locations to match each one of the multiple receptacle arrangements. Thus an inventory of different mating connectors would need to be maintained to accommodate a single size receptacle housing. It is desirable, therefore, to have a programmable mating such that for any given size housing a plurality of keyway arrangements can be easily made.

SUMMARY OF THE INVENTION

With respect to the above mentioned disadvantages, an object of this invention is to provide a programmable electrical connector that may readily be modified by the user to have a desired keyway arrangement.

Another object of the invention is to provide a continuous length of a second connector that is severable between adjacent terminals to define opposed ends of a connector of a selected length.

A further object of this invention is to provide a simple and cost effective connector that is readily provided with selected keyways.

An object of this invention has been achieved by providing an electrical connector having an insulative body defining at least one row of terminal sites having respective terminals. The body defines opposed first and second connecting faces extending between first and second sides. At least one of first or second sides defines a web between adjacent ones of all of the terminal sites, with each web disposed outwardly of a respective aperture extending between the first and second connecting faces. Each web is adapted to be easily removed to define a corresponding keyway. The connector is thereby programmable to correspond with a complimentary keyed electrical article. A second object of the present invention is achieved by providing the connector body with necked-down portions between adjacent ones of the terminal site thus facilitating severing between the first and second body sides at two selected locations between the terminal sites to define opposed ends of a connector having a selected length.

In the preferred embodiment each of the first and second sides of the insulative body defines a web between adjacent ones of the terminal sites.

DETAILED DESCRIPTION OF THE PREFERRED EMBODIMENT

Figure 1:
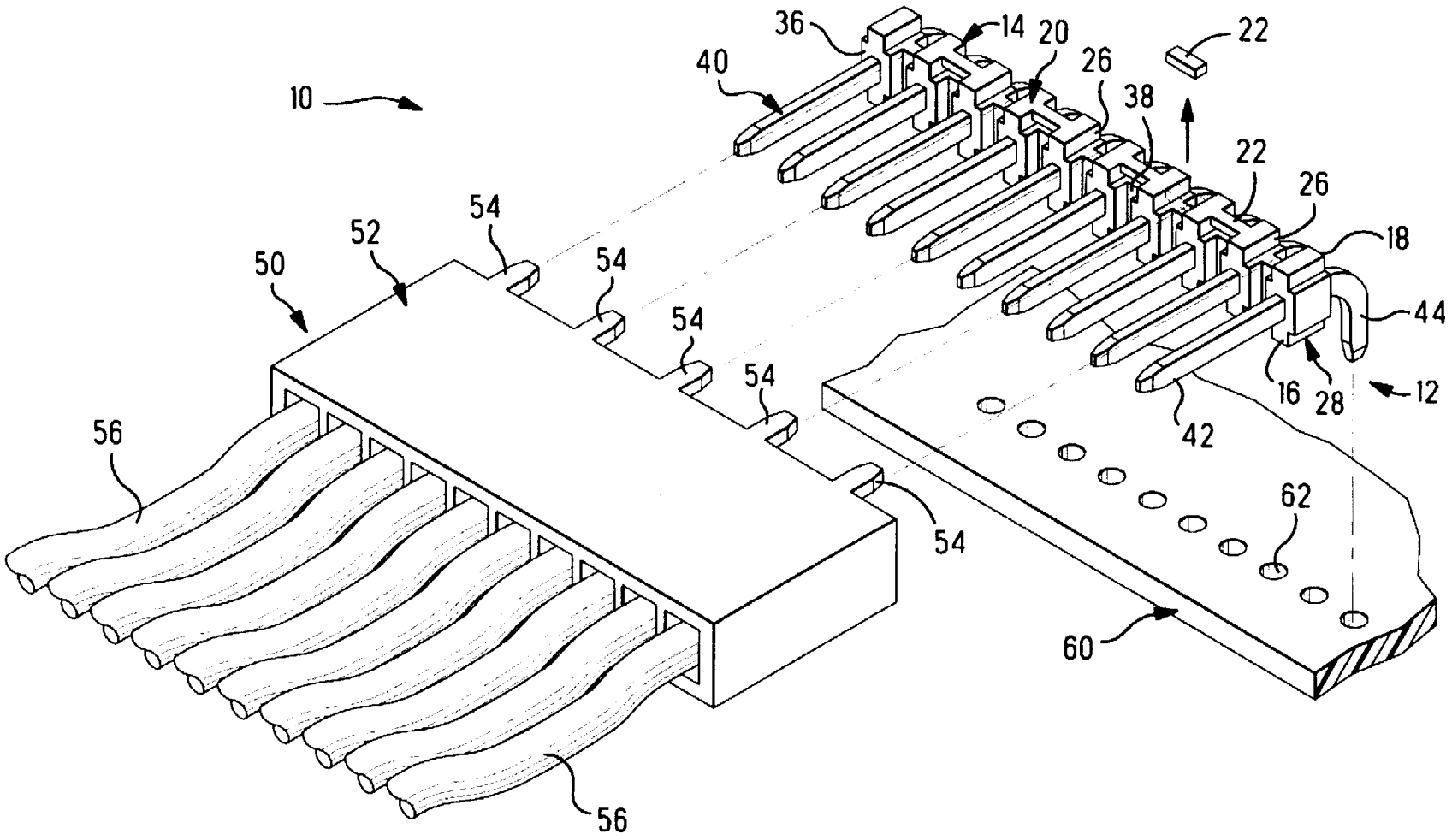
FIG. 1 is an isometric view of a connector assembly having a connector with keyways made in accordance with the invention exploded from a mating connector and exploded from a circuit board.

For purpose of illustration, the keyways of the present invention are shown on a post header 12 mountable to a circuit board 60 for mating with a receptacle connector 50 of assembly 10. It is to be understood that the invention is not limited this connector design.

The electrical connector 12, shown as post header, includes a housing body 14 having a first connecting face 16, an opposed face 18, opposed sides 20 and 28, and a plurality of terminal receiving passageways 35 extending between the first connecting face 16 and opposed face 18 defining terminal sites 36. Connector 12 includes a plurality of terminals 40 disposed in the respective apertures 35, the terminals 40 including first and second contact sections 42, 44.

Figure 2:
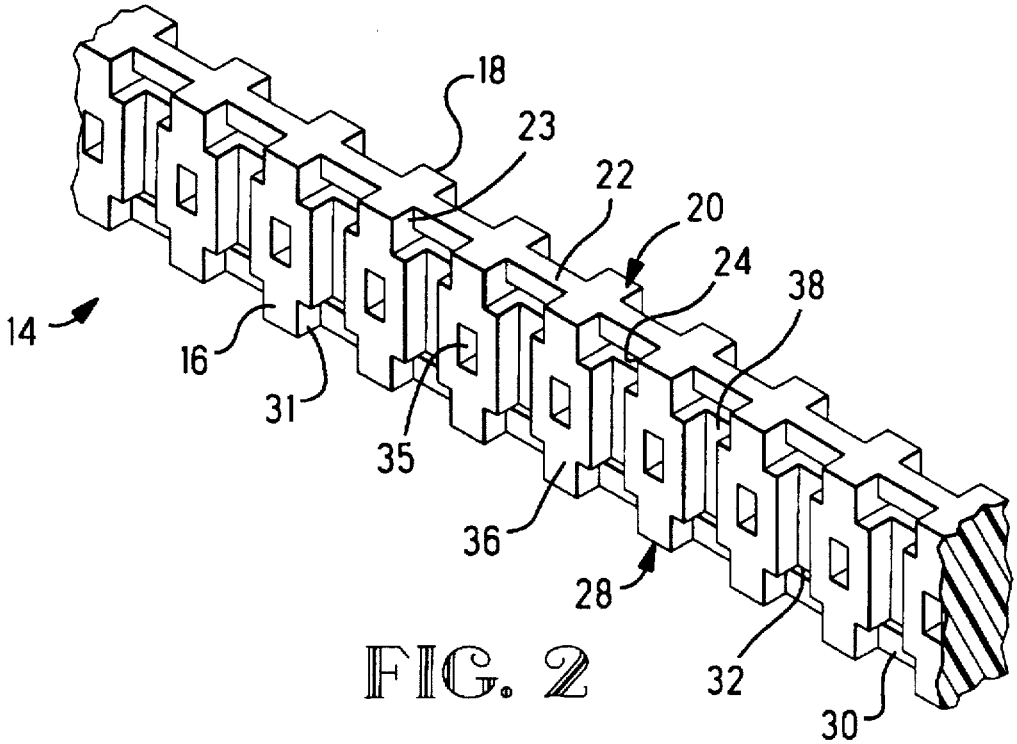
FIG. 2 is an isometric view of a strip of insulated housing for making the electrical connector having programmable keyways of FIG. 1.
Figure 3:
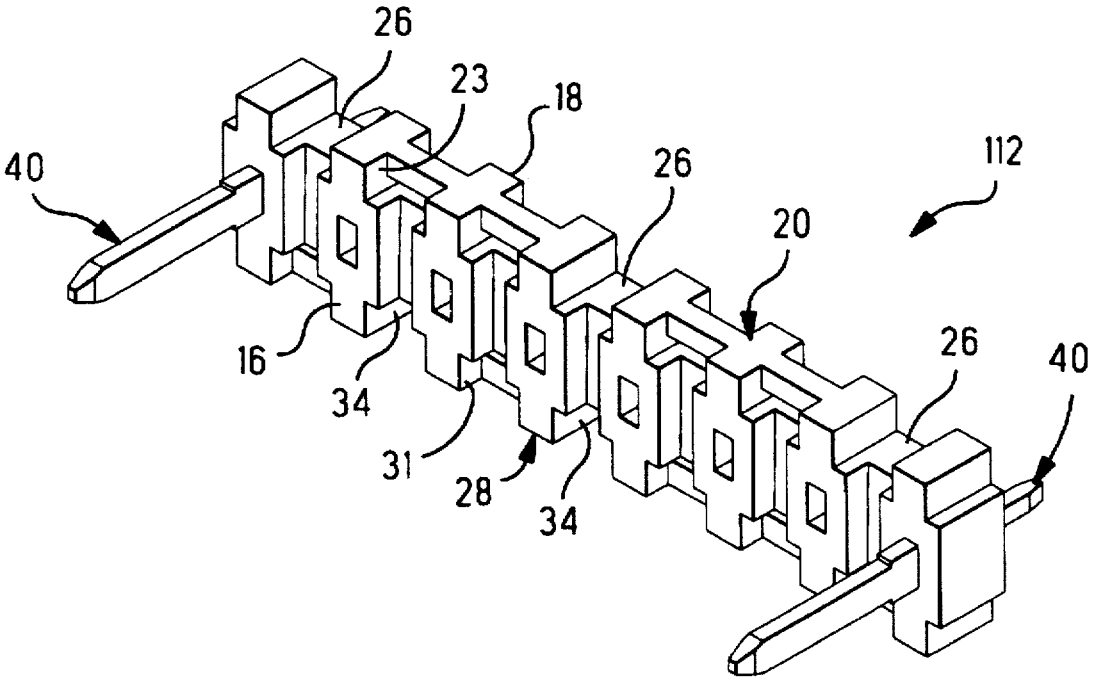
FIG. 3 is an isometric view of another embodiment of the electrical connector made in accordance with the invention illustrating keyways on two sides of the housing.

As shown in FIG. 2, the first side 20 of housing body 14 includes a web 22 extending between adjacent ones of the terminal sites 36 with each web 22 disposed outwardly of a respective aperture 24 extending between the first connecting face 16 and the opposed face 18. As also shown in FIG. 2, second side 28 includes a web 30 extending between adjacent terminal sites 36 and spaced outwardly of a respective aperture 32. Each web, 22, 30 is thus adapted to be easily removed to define a corresponding keyway 26, 34 along respective sides 20,28, between the adjacent terminal sites 36, as shown in FIG. 3. The connector 12 is thereby readily programmable to correspond with a complimentary keyed electrical article such as a cable connector shown in FIG. 1. In the preferred embodiment the body 14 further includes necked-down portions 38 between the adjacent terminal sites 36 to facilitate severing between the first and second sides at two locations between selected terminal sites 36 to define opposed ends of a connector of a selected length. In the preferred embodiment the body 14 adjacent each web 22, 30 defines a recess 23, 31 along at least the first connecting face or opposed face 18 to facilitate removal of the web 22, 30 from between the selected terminal sites 36 to form keyways 26,34 respectively.

Referring again to FIG. 1 the cable connector 50 includes a housing 52 having a plurality of keys 54 extending forwardly therefrom for receipt into corresponding keyways 26 of the connector 12 and a plurality of cables 56 extending rearwardly therefrom. For purposes of illustrating the invention, connector 12 is shown as a right angle connector mountable to circuit board 60 with second contact portions 42 of terminals 40 adapted to be received in through-holes 62 thereof.

Referring now to FIG. 3, alternative embodiment 112 of the connector assembly includes a plurality keyways 26 on the first side 20 and a further plurality of keyways 34 along the second side 28. It is thus possible to provide keyways at selected locations on both sides of the terminal sites 36, which offers the user greater programmability. Using an elongated strip as a post header, a user can selectively provide keyways 26, 34 by removing respective webs 22, 30, and also select the number of terminal sites 36 for a specific application by severing the body 14 at selected necked-down portions 38.

The present invention provides a readily programmable connector that minimizes the number of parts that need to be stocked by either the manufacturer or the user. As shown herein the post header made in accordance with the present invention can be mounted vertically or at right angles to the circuit board merely by providing straight or right angle terminals for the same housing body. The webs can be broken out with hand tools or an assembly tool that can also cut the housing to the desired length. The housing is molded from materials as known in the art that meet requirements for electrical connectors and are suitable for being severed without cracking, such as, for example, VALOX, available from General Electric.

When connector 12 is a post header, as illustrated herein, body 14 is preferably a symmetrical body as viewed from side to side and end to end, thus facilitating manufacturing and assembly processes.

It is thought that the connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector comprising:

an insulative body defining at least one row of terminal sites containing respective terminals, said body defining a connection face and an opposed face extending between opposed first and second sides; with first contact sections of said terminals exposed along said connection face for electrical connection with corresponding contacts of an electrical article; and at least one of said first and second sides defining a plurality of webs, one of said webs being between adjacent ones of all said terminals sites along an outwardly facing side surface of said body, each said web disposed outwardly of a respective aperture extending between said connection face and said opposed face, whereby each web is adapted to be easily removed to define a corresponding keyway, and said connector is thereby programmable to correspond with a complementary keyed electrical article having at least one key extending from a complementary side of a mating face.

2. The connector as set forth in claim 1 wherein said body defines necked-down portions between adjacent ones of all said terminal sites facilitating severing between said first and second sides at two selected locations between terminal sites to define opposed ends of a connector of selected length.

3. The connector as set forth in claim 1 wherein each of said first and second sides defines a said web between adjacent ones of all said terminal sites.

4. The connector as set forth in claim 1 wherein said body adjacent each said web defines a recess along at least one of said connection and opposed faces, whereby each said web is adapted to facilitate being punched for removal during programming.

5. The connector as set forth in claim 4 wherein said body defines a said recess along both said connection and opposed faces.

6. The connector as set forth in claim 1 wherein said body is substantially planar and second contact sections of said terminals extend beyond said opposed face, whereby said opposed face defines a board mounting face.

7. The connector as set forth in claim 1 wherein second contact sections of said terminals each include a right angle bend and said second contact sections extend beyond said opposed face and beyond one of said first and second sides, whereby said one of said first and second sides defines a board mounting face.

8. The connector as set forth in claim 1 wherein said connector body has a low profile.

* * * * *